US007543624B2

(12) United States Patent
Rodriguez

(10) Patent No.: US 7,543,624 B2
(45) Date of Patent: Jun. 9, 2009

(54) CURTAIN HOOK APPARATUS AND METHOD

(76) Inventor: Linda Rodriguez, 143 Montrose Ave., South Plainfield, NJ (US) 07080

( * ) Notice: Subject to any disclaimer, the term of this patent is extended or adjusted under 35 U.S.C. 154(b) by 363 days.

(21) Appl. No.: 11/309,698

(22) Filed: Sep. 15, 2006

(65) Prior Publication Data

US 2008/0067310 A1 Mar. 20, 2008

(51) Int. Cl.
*E06B 9/303* (2006.01)

(52) U.S. Cl. ..... 160/178.1 R

(58) Field of Classification Search ..... 248/208, 248/252, 254, 262, 264, 267; 160/178.1 R, 160/902, 168.1 R, 38, 39, 173 R
See application file for complete search history.

(56) References Cited

U.S. PATENT DOCUMENTS 6,382,295 B1 * 5/2002 Nicholson ..... 160/178.1 R
2006/0175025 A1 * 8/2006 McMenamin et al. . 160/178.1 R

* cited by examiner

*Primary Examiner*—J. Allen Shriver, II
*Assistant Examiner*—Erin Smith
(74) *Attorney, Agent, or Firm*—Walter J. Tencza, Jr.

(57) ABSTRACT

An apparatus is provided which allows curtain attachment devices to be easily connected to blind mounting devices, without the need for additional screws and additional hangers. In one embodiment of the present invention, an apparatus is provided including first, second, third, and fourth devices. The first and third devices may be conventional mounting brackets for conventional blinds. The second and fourth devices may attach to the first and third devices, respectively, to allow a curtain rod or bracket to be attached.

17 Claims, 8 Drawing Sheets

CURTAIN HOOK APPARATUS AND METHOD

FIELD OF THE INVENTION

This invention relates to improved methods and apparatus concerning curtain and blind attachment devices.

BACKGROUND OF THE INVENTION

There are various devices known in the prior art for attaching curtains and blinds to a window frame or wall.

SUMMARY OF THE INVENTION

One or more embodiments of the present invention allow curtain attachment devices to be easily connected to blind mounting devices, without the need for additional screws and additional hangers.

In one embodiment of the present invention, an apparatus is provided including first, second, third, and fourth devices. The first and third devices may be conventional mounting brackets for convention blinds. The first and third devices may be identical and may each have a top, a bottom, a first side, a second side, and a rear wall which form an open box, the open box having an opening leading to a chamber. The second and fourth devices attach to the first and third devices, respectively, to allow a curtain rod or bracket to be attached. The second and fourth devices may be mirror images of each other and may each have a first plate and a first attachment device connected to the first plate, such that the first attachment device is substantially perpendicular to the first plate. The second and fourth devices may each further include a second attachment device connected to their corresponding first plate, wherein an end of a curtain bracket or rod can be attached to the corresponding second attachment device of the respective second or fourth devices.

In one embodiment at least a portion of the first attachment device of the second or fourth devices can be inserted through an opening in the first side of the first or third devices and slid into the chamber of the first or third devices to attach the second or fourth device to the first or third device, so that the first plate of the second or fourth device is substantially perpendicular to the top, bottom, and rear wall of the first or third device, respectively.

The second and fourth devices may each further include a second attachment device connected to their corresponding first plate, wherein an end of a curtain bracket or rod can be attached to the second attachment device of the corresponding second or fourth device.

In one embodiment, the first device can be connected to a first window frame piece so that the rear wall of the first device lies adjacent to, in contact with, and parallel to an inner surface of the first window frame piece, while at the same time the first plate of the second device lies adjacent to, in contact with, and parallel to an outer surface of the first window frame piece. Similarly, the third device can be connected to a second window frame piece, opposite the first window frame piece, so that the rear wall of the third device lies adjacent to, in contact with, and parallel to an inner surface of the second window frame piece, while at the same time the first plate of the fourth device lies parallel to an outer surface of the second window frame piece. In this embodiment the inner surfaces of the first and second window frame pieces are substantially perpendicular to the outer surfaces of the first and second window frame pieces.

In one embodiment, the first device can be connected to a first window frame piece so that the first side of the first device lies adjacent to, in contact with, and parallel to an outer surface of the first window frame piece, while at the same time the plate of the second device lies parallel to the outer surface of the first window frame piece. Similarly, the third device can be connected to a second window frame piece, opposite the first window frame piece, so that the first side of the third device lies adjacent to, in contact with, and parallel to an outer surface of the second window frame piece, while at the same time the plate of the second device lies parallel to the outer surface of the second window frame piece.

The first attachment devices of the second and fourth devices may be U-shaped. The openings in the first sides of the first and third devices may be elongated slots. The openings in the first sides of the first and third devices can be covered by panels, which can slide over the openings.

At least one embodiment of the present invention provides a method including providing first, second, third, and fourth devices as specified previously. The method may also include inserting at least a portion of the first attachment device of the second device through an opening in the first side of the first device and sliding the portion into the chamber of the first device to attach the second device to the first device, so that the first plate of the second device is substantially perpendicular to the top, bottom, and rear wall of the first device. The method may also include inserting at least a portion of the first attachment device of the fourth device through an opening in the first side of the third device and sliding the portion into the chamber of the third device to attach the fourth device to the third device, so that the first plate of the fourth device is substantially perpendicular to the top, bottom, and rear wall of the third device.

DETAILED DESCRIPTION OF THE DRAWINGS

Figure 1A:
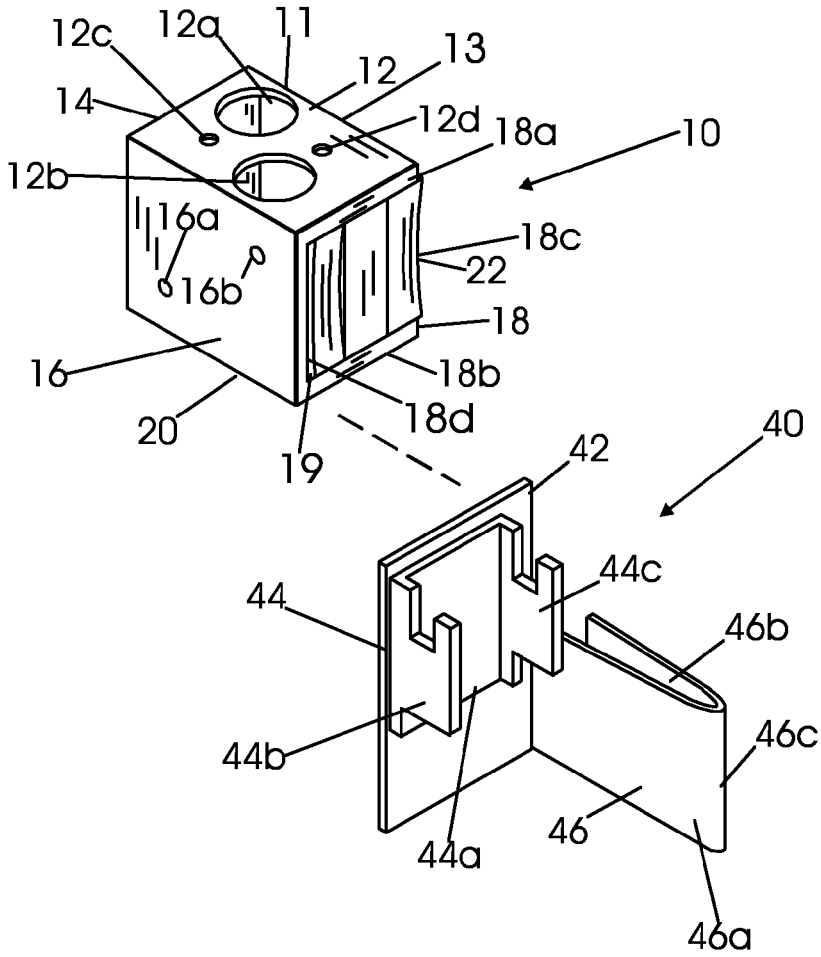
FIG. 1A shows a perspective view of first and second devices for use with an embodiment of the present invention, with the first and second devices separated.
Figure 1B:
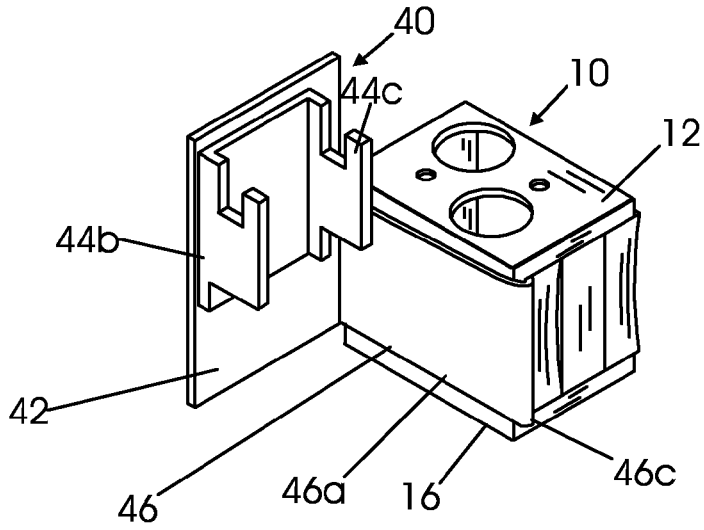
FIG. 1B shows a perspective view of the first and second devices, with the first and second devices put together.

FIG. 1A shows a perspective view of a first device 10 and a second device 40 for use with an embodiment of the present invention, with the first device 10 and the second device 40 shown separated. FIG. 1B shows a perspective view of the first device 10 and the second device 40, with the devices 10 and 40 put together.

The first device 10 may be substantially in the shape of an open box with a top 12, a side 14, a rear wall 16, a side 18, and a bottom 20. The side 18 may have portions 18*a* and 18*b*, and a large opening 18*c*, which is covered by a panel 22. The panel 22 can be slid into the opening 18*c* to cover the opening 18*c*. The portions 18*a* and 18*b* may include slots for allowing the panel 22 to slide into the opening 18*c* to cover the opening 18*c*. The top 12 may have large circular openings 12*a* and 12*b* and small circular openings 12*c* and 12*d*. The rear wall 16 may have small circular openings 16*a* and 16*b*, which may be large enough to accommodate a screw with about one-eighth of an inch diameter threads. The solid portions of the first device 10 may be made of a rigid plastic. The first device 10 may be the same as a device 100 shown in FIG. 2A. The device 100 may be the first device 10 flipped over, so that the bottom 20 (which is 120 in FIG. 2A) is on top and the top 12 (which is 112 in FIG. 2A) is on the bottom. The device 10 has an opening 11 which corresponds to an opening 111 in FIG. 2A. The opening 11 leads to an inner chamber 13 corresponding to an inner chamber 113 in FIG. 2A.

The second device 40, shown in FIGS. 1A-B, includes a plate 42, an attachment device 44, and an attachment device 46. The attachment device 44 may include a first hook device 44*b* and a second hook device 44*c* attached to a plate 44*a*. The plate 44*a* may be fixed to the plate 42. The first hook device 44*b* and the second hook device 44*c* may be configured so that a first end of a curtain bracket or rod can attach to the first and second hook devices 44*b-c*. The attachment device 46 may include portion 46*a* and portion 46*b* which are connected by portion 46*c*. The portions 46*a* and 46*b* may be substantially flat plates while the portion 46*c* may be a curved plate. The attachment device 46 may be fixed so that the portions 46*a* and 46*b* are substantially perpendicular to the plate 42 and to the plate 44*a*.

Figure 2A:
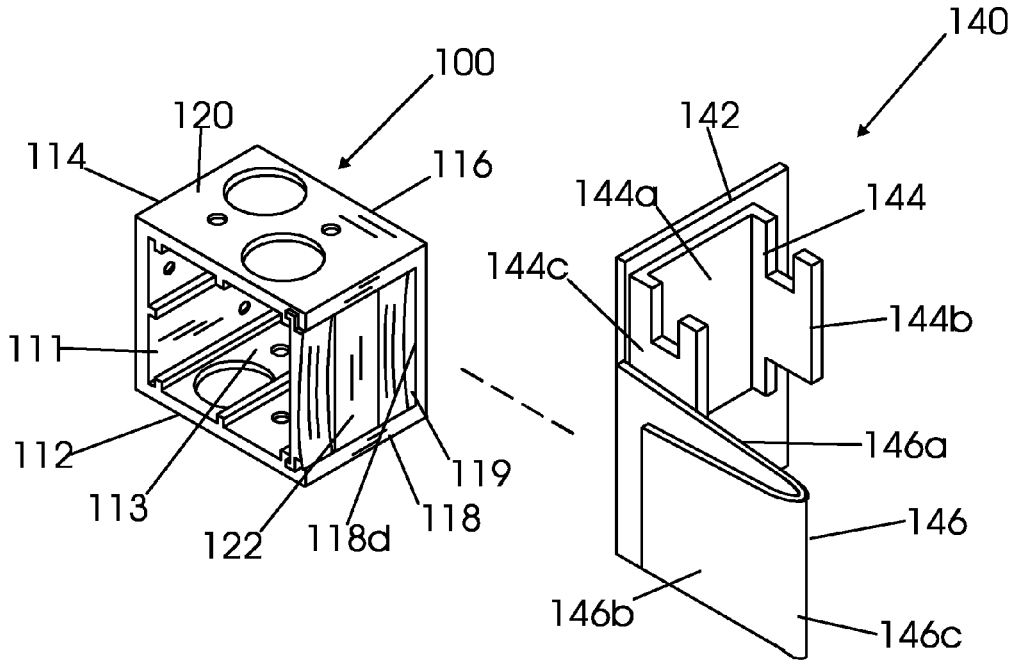
FIG. 2A shows a perspective view of third and fourth devices for use with an embodiment of the present invention, with the third and fourth devices separated.

The portion 46*b* of the attachment device 46 can be inserted into a gap or slot 19 between the panel 22 and an edge 18*d* of the side 18, and into the chamber 13 (within device 10, corresponding to chamber 113 in FIG. 2A). The portion 46*b* then can be slid further into the chamber 13 so that the portion 46*b* overlaps a substantial portion, such as the majority, of rear wall 16, within the chamber 13. In this manner, the device 40 is attached to the device 10 as shown in FIG. 1B.

Figure 2B:
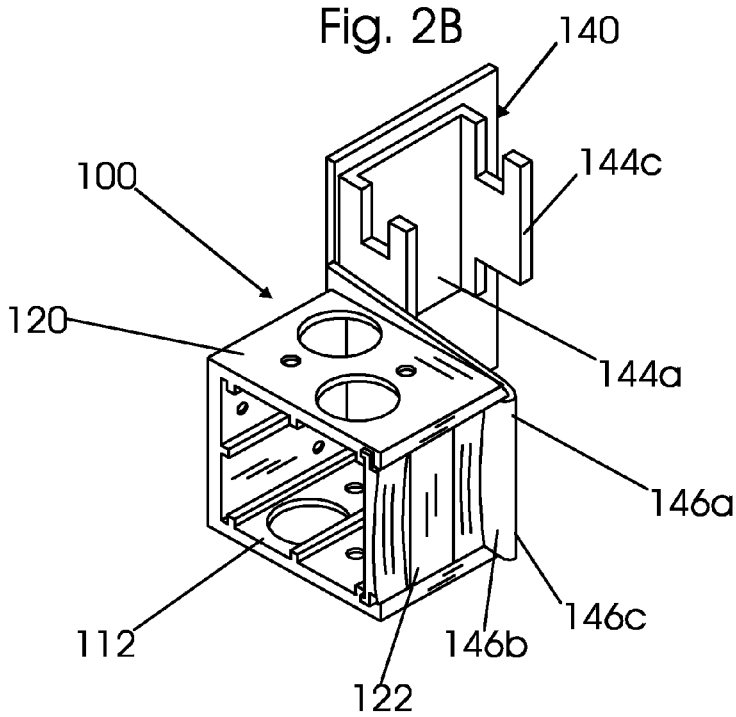
FIG. 2B shows a perspective view of the third and fourth devices, with the third and fourth devices put together.

FIG. 2A shows a perspective view of a third device 100 and a fourth device 140 for use with an embodiment of the present invention, with devices 100 and 140 shown separated. FIG. 2B shows a perspective view of the devices 100 and 140, with the devices 100 and 140 put together. The device 100, as discussed, is identical to the device 10, with the exception that it has been flipped over. The device 100 includes opening 111, bottom 112, chamber 113, side 114, rear wall 116, side 118, slot 119, top 120, and panel 122, which correspond to opening 11, top 12, chamber 13, side 14, chamber 13, rear wall 16, side 18, slot 19, bottom 20, and panel 22, respectively of device 10.

The fourth device 140 is a mirror image of the device 40 of FIG. 1A. The device 140 includes a plate 142, an attachment device 144, and an attachment device 146. The attachment device 144 may include a first hook device 144*b* and a second hook device 144*c* attached to a plate 144*a*. The plate 144*a* may be fixed to the plate 142. The first hook device 144*b* and the second hook device 144*c* may be configured so that a second end of a curtain bracket or rod, opposite the first end, can attach to the first and second hook devices 144*b-c*. The attachment device 146 may include a portion 146*a* and a portion 146*b* which are connected by portion 146*c*. The portions 146*a* and 146*b* may be substantially flat plates while the portion 146*c* may be a curved plate. The attachment device 146 may be fixed so that the portions 146*a* and 146*b* are substantially perpendicular to the plate 142 and to the plate 144*a*.

The portion 146*b* of the attachment device 146 can be inserted into the gap or slot 119 between the panel 122 and an edge 118*d* of the side 118, and into a chamber 113. The portion 146*b* then can be slid further into the chamber 113 so that the portion 146*b* overlaps a substantial portion, such as the majority, of rear wall 116, within the chamber 113. In this manner, the device 140 is attached to the device 100 as shown in FIG. 2B.

Figure 3:
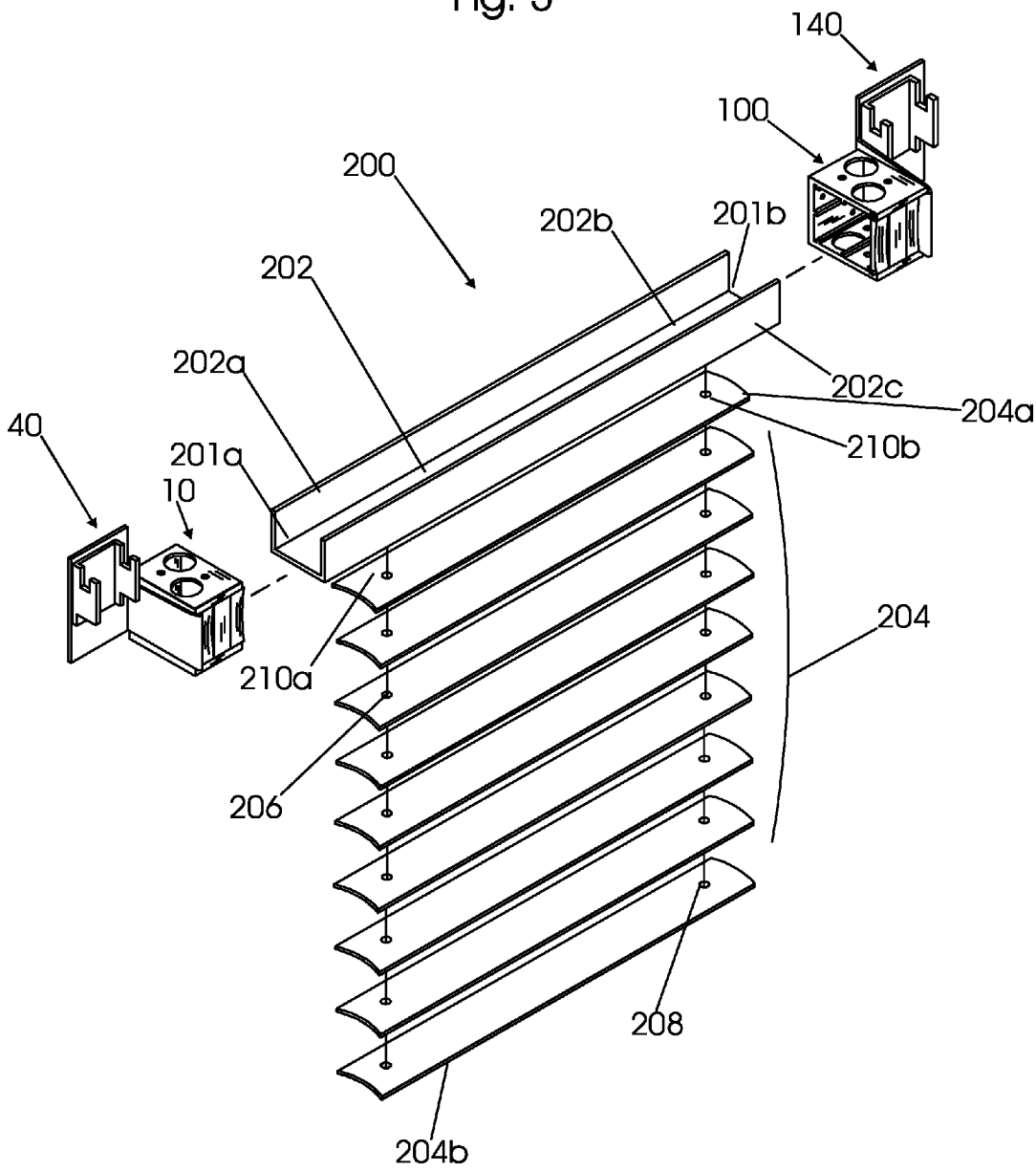
FIG. 3 shows a perspective view of the first and second devices put together, the third and fourth devices put together, and an apparatus including a set of blinds and a mounting device.

FIG. 3 shows a perspective view of the devices 10 and 40 put together, the devices 100 and 140 put together, and an apparatus 200 including, a set of blinds 204 and a mounting device 202. The mounting device 202 includes a U-shaped member having side 202*a*, bottom 202*b*, and side 202*c*. A string 206 is inserted through holes in blinds 204, such as hole 210*a* in blind 204*a*. One end of the string 206 is attached to the mounting device 202, while an opposite end of the string 206 is attached to blind 204*b*. The string 206 may have intermediate knots or some other known device for providing adequate separation between adjacent blinds. String 208 is inserted through holes in blinds 204, such as hole 210*b* in blind 204*a*. One end of the string 208 is attached to the mounting device 202, while an opposite end of the string 208 is attached to blind 204*b*. The string 208 may have intermediate knots or some other known device for providing adequate separation between adjacent blinds.

Figure 4:
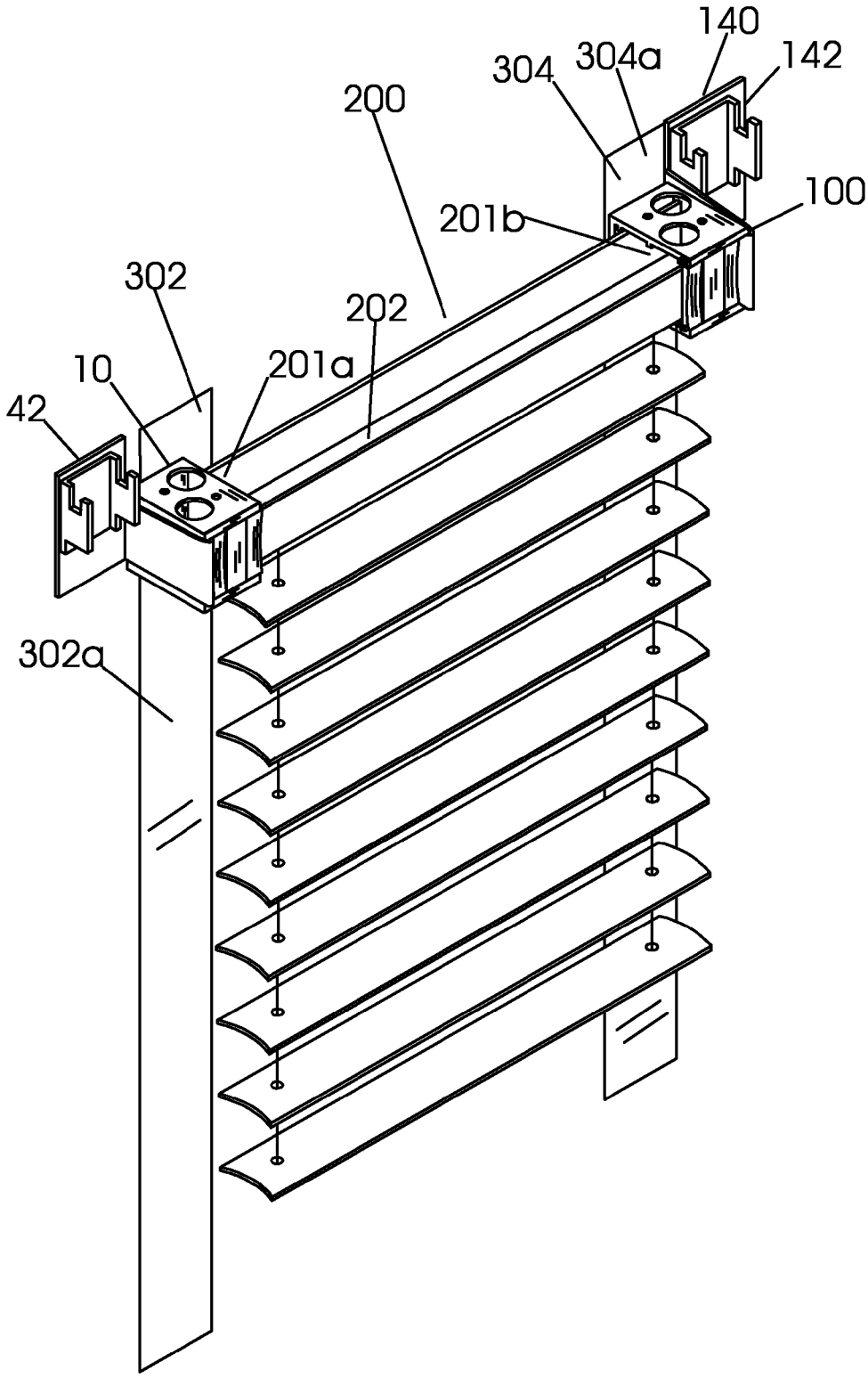
FIG. 4 shows a perspective view of the first and second devices put together, the third and fourth devices put together, the apparatus including a set of blinds and a mounting device, with a first end of the mounting device inserted into the first device and a second end of the mounting device inserted into the third device, and with the first and third devices mounted to outside surfaces of window frame pieces.

FIG. 4 shows a perspective view of the devices 10 and 40 put together, the devices 100 and 140 put together, and the apparatus 200, with a first end 201*a* of the mounting device 202 inserted into the chamber 13 of the device 10 and a second opposing end 201*b* of the mounting device 202 inserted into the chamber 113 of the device 100. FIG. 4 also shows the devices 10 and 100 mounted to outside surfaces 302*a* and 304*a* of window frame pieces 302 and 304, respectively.

In operation, an individual may first slide out panel 22, to expose opening 18*c* for device 10, insert screws through holes in the side 14 (similar to holes in side 114 in FIG. 2A) and drive the screws into the window frame piece 302 (through surface 302*a*) to fix device 10 to frame piece 302. The side 14 will typically be fixed substantially flat, against, adjacent to, parallel to, and in contact with the surface 302*a*. The individual may then slide out panel 122, to expose opening 118*c* for device 100, and insert screws through holes in the side 114 and drive the screws into the window frame piece 304 (through surface 304*a*) to fix the device 100. The side 114 will typically be fixed substantially flat, against, adjacent to, parallel to, and in contact with the surface 302*a*. The individual may then insert first and second ends, 201*a* and 201*b* of mounting device 202, through the openings 18*c* and 118*c* and into the chambers 13 and 113 of devices 10 and 100, respectively. With end 201*a* in chamber 13 and end 201*b* in chamber 113, the individual can then substantially close the openings 18*c* and 118*c* (leaving slots 19 and 119 respectively) by sliding in panels 22 and 122. The individual may then attach device 40 by sliding portion 46*b* into slot 19 (as shown by FIGS. 1A-B) and may attach device 140 by sliding portion 146*b* into slot 119 (as shown by FIGS. 2A-B). As shown in FIG. 4, after mounting, the plates 42 and 142 lie substantially parallel to the surfaces 302*a* and 304*a*, respectively.

Figure 5A:
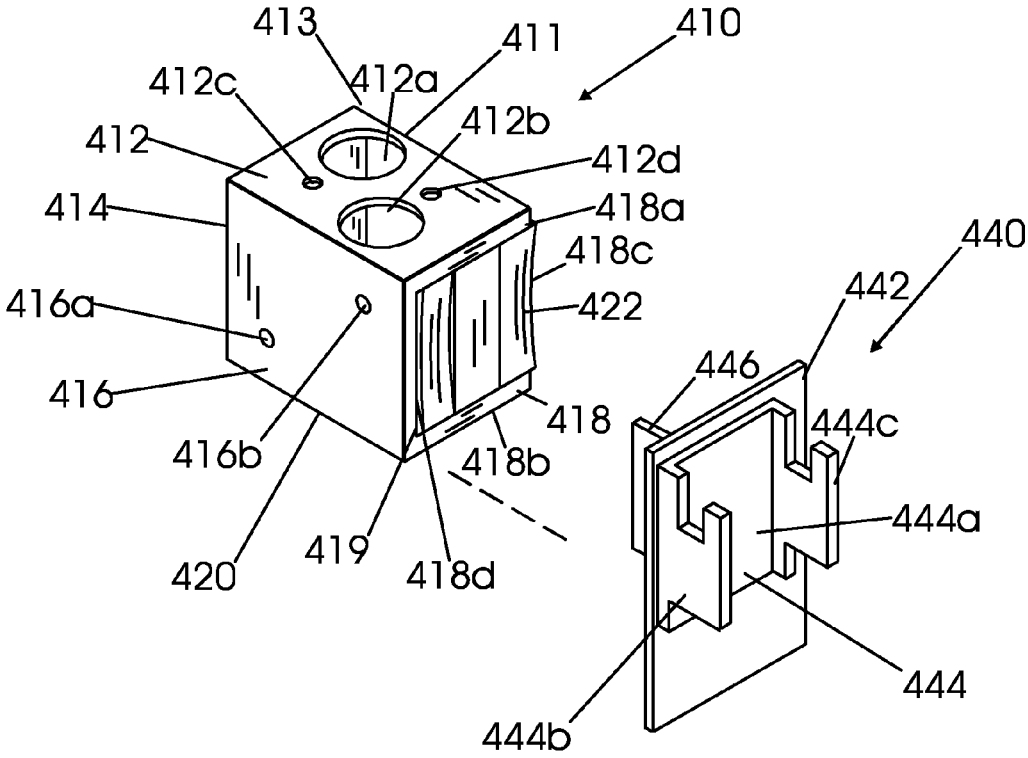
FIG. 5A shows a perspective view of fifth and sixth devices for use with another embodiment of the present invention, with the fifth and six devices separated.
Figure 5B:
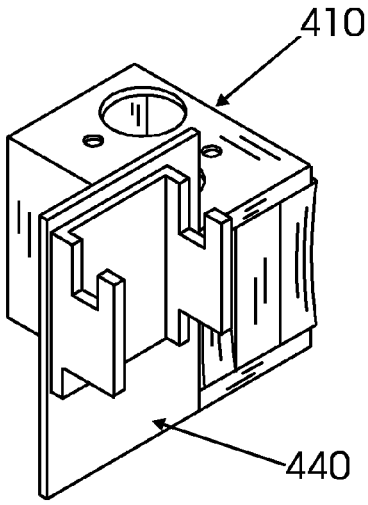
FIG. 5B shows a perspective view of the fifth and sixth devices, with the fifth and sixth devices put together.

FIG. 5A shows a perspective view of a fifth device 410 and a second device 440 for use with another embodiment of the present invention, with the fifth device 410 and the second device 440 shown separated. FIG. 5B shows a perspective view of the fifth device 410 and the second device 440, with the devices 410 and 440 put together.

The fifth device 410 may be identical to the first device 10 of FIG. 1A. The fifth device 410 may be in the shape of an open box with a top 412, side 414, rear wall 416, side 418, and a bottom 420. The side 418 may have portions 418*a* and 418*b*, and a large opening 418*c*. A panel 422 can be slid into the opening 418*c* to cover the opening 418*c*. The portions 418*a* and 418*b* may have slots for sliding the panel 422 into the opening 418*c*. The top 412 may have large circular openings 412*a* and 412*b* and small circular openings 412*c* and 412*d*. The rear wall 416 may have small circular openings 416*a* and 416*b*, which may be large enough to accommodate a screw with about one-eighth of an inch diameter threads. The solid portions of the fifth device 410 may be made of a rigid plastic. The fifth device 410 may be the same as a seventh device 500 shown in FIG. 6A. The seventh device 500 may be the fifth device 10 flipped over, so that the bottom 420 (which is 520 in FIG. 6A) is on top and the top 412 (which is 512 in FIG. 6A) is on the bottom. The device 410 has an opening 411 leading to a chamber 413, which correspond to the opening 511 and chamber 513 in FIG. 6A.

The sixth device 440, shown in FIGS. 5A-B differs from the second device 40 shown in FIGS. 1A-B. The sixth device 440 includes a plate 442, an attachment device 444, and an attachment device 446. The attachment device 444 may include a first hook device 444*b* and a second hook device 444*c* attached to a plate 444*a*. The plate 444*a* may be fixed to the plate 442. The first hook device 444*b* and the second hook device 444*c* may be configured so that a first end of a curtain bracket or rod can attach to the first and second hook devices 444*b-c*. The attachment device 446 may be comprised of a single protrusion or plate, unlike the configuration for device 40 shown in FIGS. 1A-B. The attachment device 446 may be fixed substantially perpendicular to the plate 442 and to the plate 444*a*.

Figure 6A:
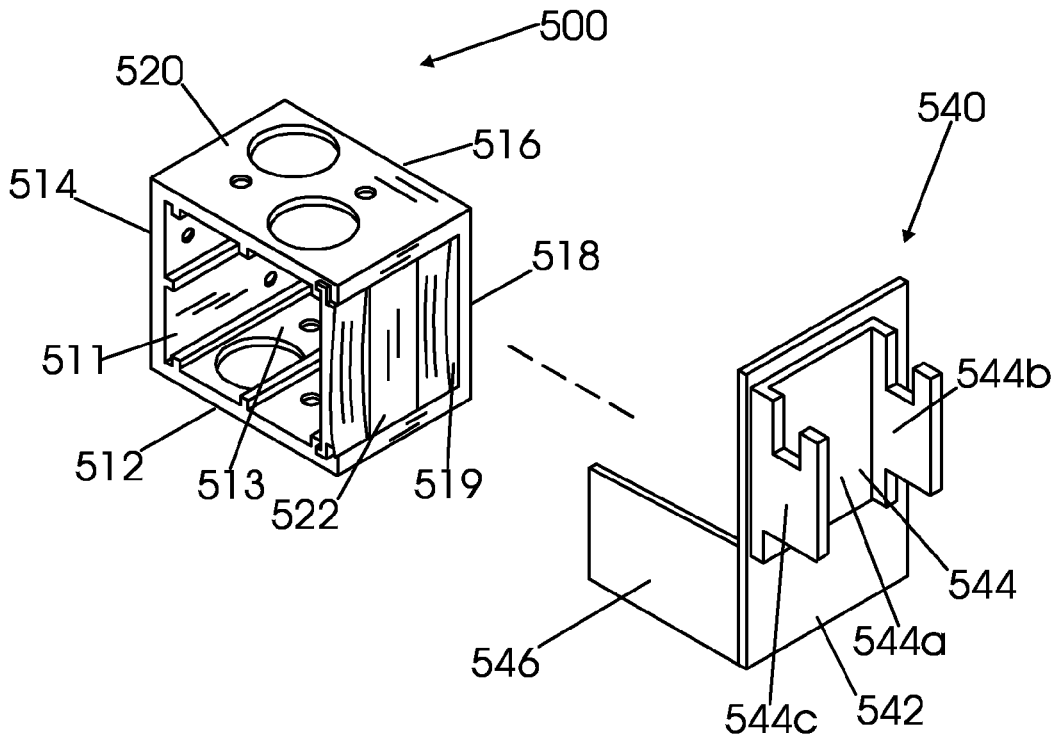
FIG. 6A shows a perspective view of seventh and eighth devices for use with an embodiment of the present invention, with the seventh and eighth devices separated.

The attachment device 446 can be inserted into a gap or slot 419 between the panel 422 and an edge 418*d* of the side 418, and into a chamber 413 (within device 410, corresponding to chamber 513 in FIG. 6A). The attachment device 446 then can be slid further into the chamber 413 so that the attachment device 446 overlaps a substantial portion, such as the majority, of rear wall 416, within the chamber 413. In this manner, the device 440 is attached to the device 410 as shown in FIG. 5B.

Figure 6B:
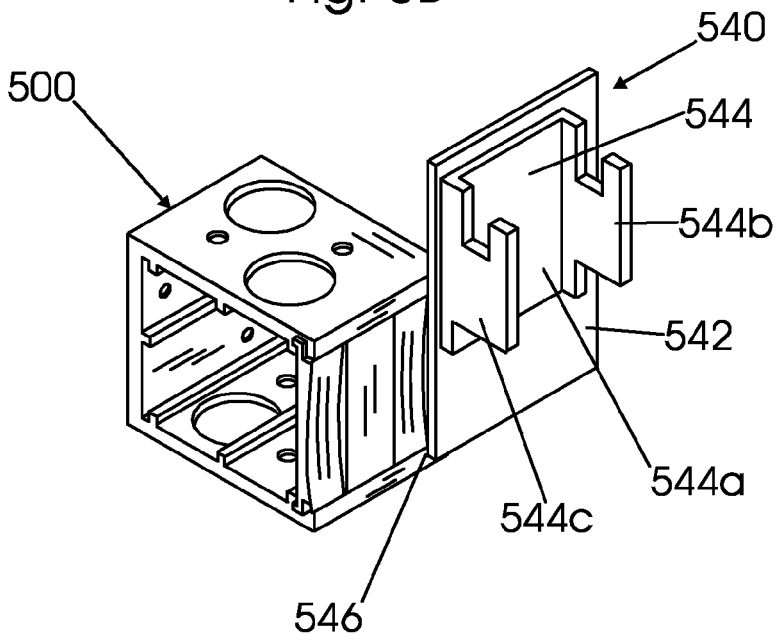
FIG. 6B shows a perspective view of the seventh and eighth devices, with the seventh and eighth devices put together.

FIG. 6A shows a perspective view of a seventh device 500 and an eighth device 540 for use with an embodiment of the present invention, with devices 500 and 540 shown separated. FIG. 6B shows a perspective view of the devices 500 and 540, with the devices 500 and 540 put together. The device 500, as discussed, is identical to the device 410, with the exception that it has been flipped over. The device 500 includes an opening 511, a bottom 512, a chamber 513, a side 514, a rear wall 516, a side 518, a slot 519, a top 520, and a panel 522, which correspond to the opening 411, the top 412, the chamber 413, the side 414, the rear wall 416, the side 418, the slot 419, the bottom 420, and panel 422, respectively of device 410.

The fourth device 540 is a mirror image of the device 440 of FIG. 5A. The device 540 includes a plate 542, an attachment device 544, and an attachment device 546. The attachment device 544 may include a first hook device 544*b* and a second hook device 544*c* attached to a plate 544*a*. The plate 544*a* may be fixed to the plate 542. The first hook device 544*b* and the second hook device 544*c* may be configured so that a second end of a curtain bracket or rod, opposite the first end, can attach to the first and second hook devices 544*b-c*. The attachment device 546 be comprised of a single straight plate. The attachment device 546 may be fixed substantially perpendicular to the plate 542 and to the plate 544*a*.

The attachment device 546 can be inserted into the gap or slot 519 between the panel 522 and an edge 518*d* of the side 518, and into the chamber 513. The attachment device 546 then can be slid further into the chamber 513 so that the attachment device 546 overlaps a substantial portion, such as the majority, of the rear wall 516, within the chamber 513. In this manner, the device 540 is attached to the device 500 as shown in FIG. 6B.

Figure 7:
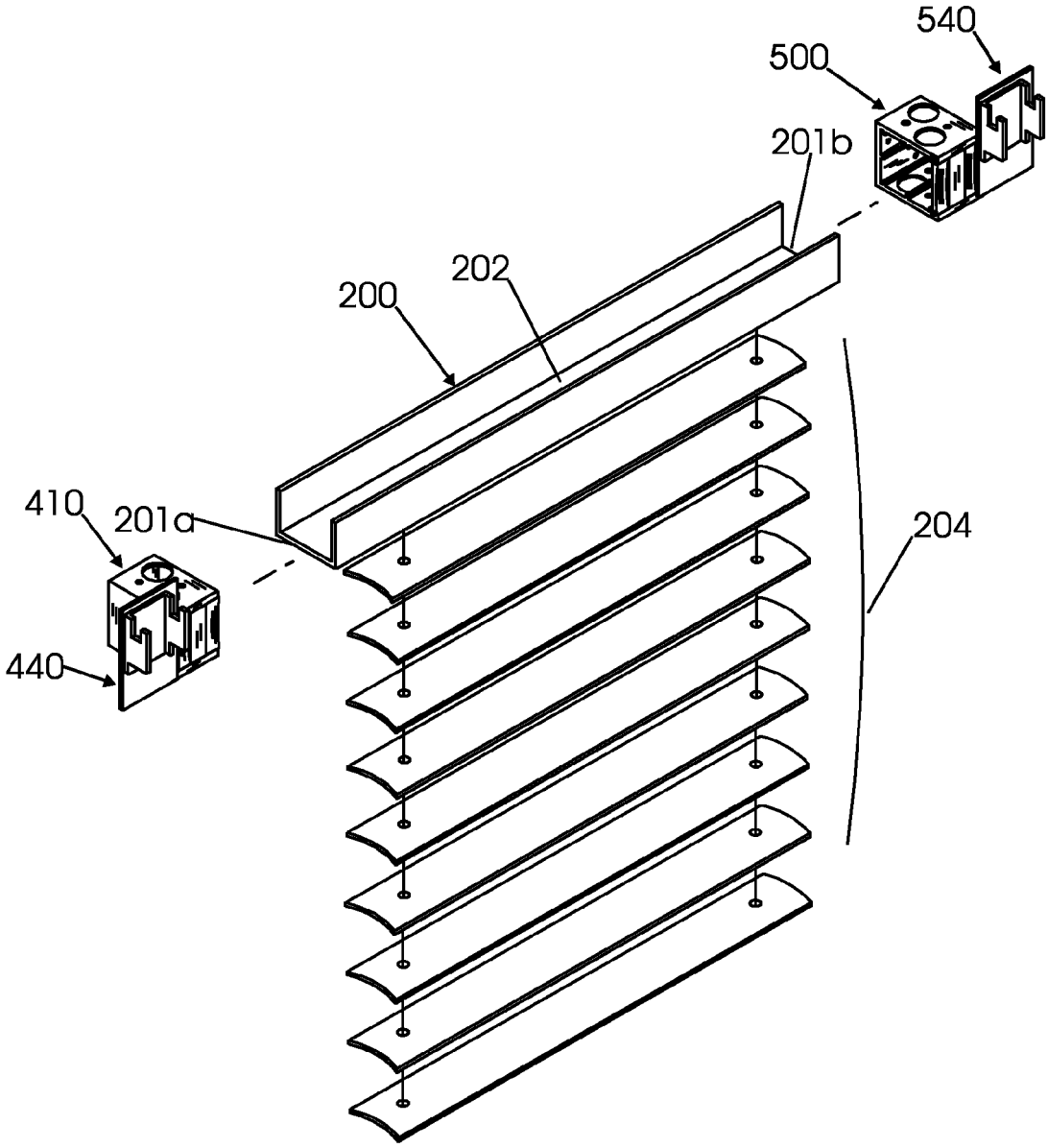
FIG. 7 shows a perspective view of the fifth and sixth devices put together, the seventh and eighth devices put together, and the apparatus including the set of blinds and the mounting device.

FIG. 7 shows a perspective view of the devices 410 and 440 put together, the devices 500 and 540 put together, and the apparatus 200 including the set of blinds 204 and the mounting device 202.

Figure 8:
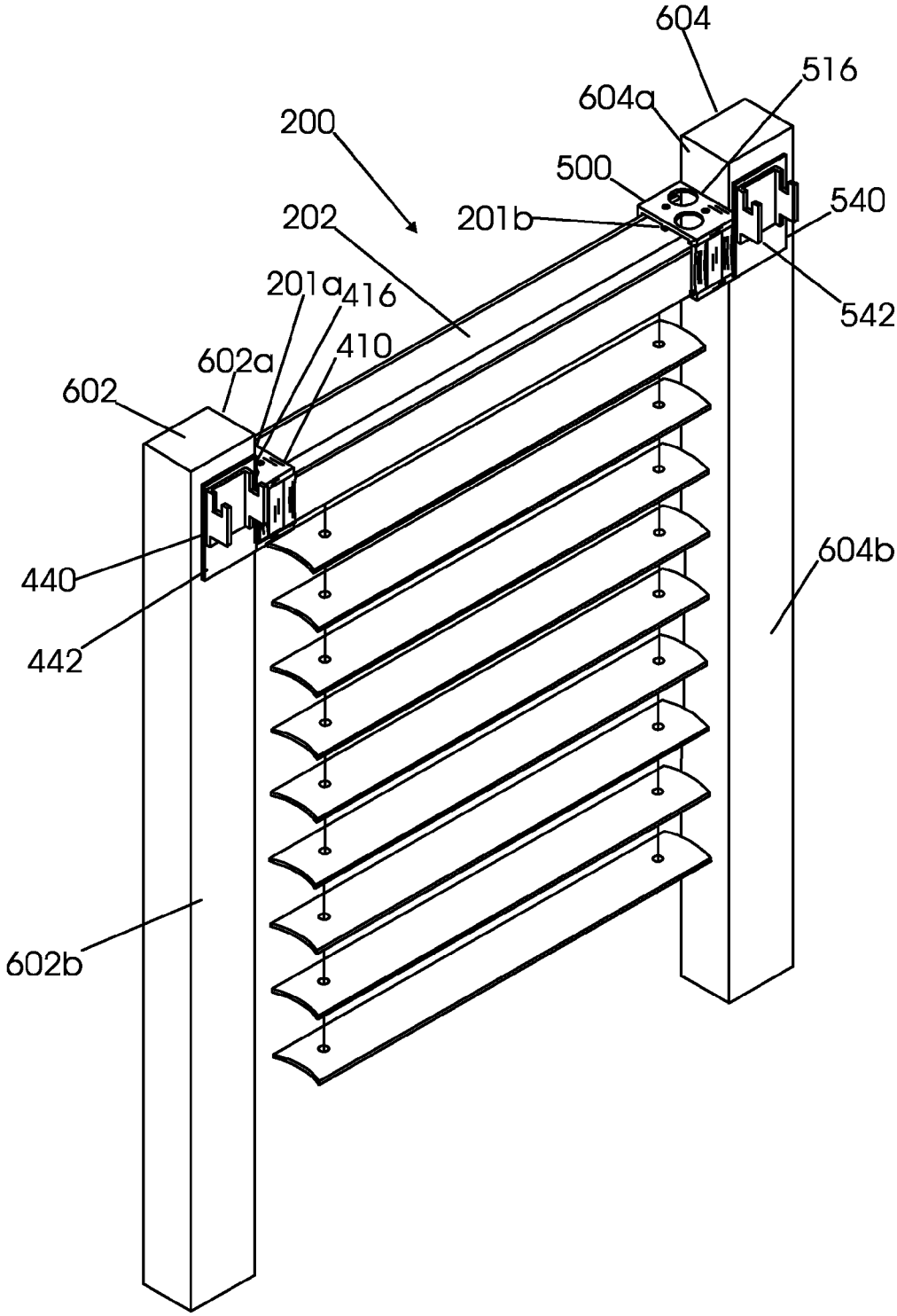
FIG. 8 shows a perspective view of the fifth and sixth devices put together, the seventh and eighth devices put together, the apparatus including the set of blinds and the mounting device, with a first end of the mounting device inserted into the fifth device and a second end of the mounting device inserted into the seventh device, and with the fifth and seventh devices mounted to inside surfaces of window frame pieces.

FIG. 8 shows a perspective view of the devices 410 and 440 put together, the devices 500 and 540 put together, and the apparatus 200, with the first end 201*a* of the mounting device 202 inserted into the chamber 413 of the device 410 and the second opposing end 201*b* of the mounting device 202 inserted into the chamber 513 of the device 500. FIG. 8 also shows the devices 410 and 500 mounted to inner surfaces 602*a* and 604*a*, of window molding or frame pieces 602 and 604, respectively. Thus the plates 442 and 542 lie flat, parallel to, in contact with, and adjacent to outer surfaces 602*b* and 604*b*, while surfaces 416 and 516 are adjacent to, parallel to and in contact with inner surfaces 602*a* and 604*a*, respectively.

In operation, an individual may first insert screws through holes in the rear surface 416 of device 410 and drive the screws through the holes, through the inner surface 602*a*, and into the window frame piece 602 to fix device 410. The device 410 is fixed so that the plate 442 lies flat, in contact with, and parallel to the surface 602*b* of the frame piece 602. The inner surface 602*a* is typically perpendicular to the outer surface 602*b*.

The individual may also insert screws through holes in the rear surface 516 of device 500 and drive the screws through the holes, then through inner surface 604*a*, and into window frame piece 604 to fix device 500 to the window frame piece 604. The device 500 is fixed so that the plate 542 lies flat, in contact with, and parallel to the surface 604*b* of the frame piece 604. The inner surface 604*a* is typically perpendicular to the outer surface 604*b*.

The individual may then slide out panel 422, to expose opening 418*c* and insert the first end 201*a* of the mounting device 202 into chamber 413 of device 410. The individual may also slide out panel 522 and insert the second end 201*b* of the mounting device 202 into the chamber 513 of the device 500. The panels 422 and 522 can be slid back into sides 418 and 518 of devices 410 and 500, respectively, to close and secure the mounting device 202 in the devices 410 and 500.

The devices 10, 40, 100, 140, 410, 440, 500, and 540 may be made of metal, plastic, or other materials. The devices 10, 40, 100, 140, 410, 440, 500, and 540 may be used with curtain brackets or rods which can include for example round rods or other shapes.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

What is claimed is:

1. An apparatus for hanging one or more blinds and one or more curtains comprising:

a first device having a top, a bottom, a first side, a second side, and a rear wall which form an open box, the open box having an opening leading to a chamber;

a second device having a first plate and a first attachment device connected to the first plate of the second device, such that the first attachment device of the second device is substantially perpendicular to the first plate of the second device;

wherein at least a portion of the first attachment device of the second device can be inserted through an opening in the first side of the first device and slid into the chamber of the first device to attach the second device to the first device, so that the first plate of the second device is substantially perpendicular to the top, bottom, and rear wall of the first device;

wherein the second device further includes a second attachment device connected to the first plate of the second device, and wherein a first end of a curtain bracket can be attached to the second attachment device of the second device;

a third device having a top, a bottom, a first side, a second side, and a rear wall which form an open box, the open box having an opening leading to a chamber;

a fourth device having a first plate and a first attachment device connected to the first plate of the fourth device, such that the first attachment device of the fourth device is substantially perpendicular to the first plate of the fourth device;

wherein at least a portion of the first attachment device of the fourth device can be inserted through an opening in the first side of the third device and slid into the chamber of the third device to attach the fourth device to the third device, so that the first plate of the fourth device is substantially perpendicular to the top, bottom, and rear wall of the third device;

wherein the fourth device further includes a second attachment device connected to the first plate of the fourth device, and wherein a second end of the curtain bracket can be attached to the second attachment device of the fourth device;

wherein the first device can be connected to a first window frame piece so that the rear wall of the first device lies adjacent to, in contact with, and parallel to an inner surface of the first window frame piece, while at the same time the first plate of the second device lies adjacent to, in contact with, and parallel to an outer surface of the first window frame piece;

wherein the inner surface of the first window frame piece is substantially perpendicular to the outer surface of the first window frame piece;

wherein the third device can be connected to a second window frame piece, opposite the first window frame piece, so that the rear wall of the third device lies adjacent to, in contact with and parallel to an inner surface of the second window frame piece; and wherein the inner surface of the second window frame piece is substantially perpendicular to an outer surface of the second window frame piece.

2. The apparatus of claim 1 wherein when the second device is attached to the first device by the first attachment device of the second device the first plate of the second device extends outward away from the first device; and when the fourth device is attached to the third device by the first attachment device of the fourth device, the first plate of the fourth device extends outward away from the third device.

3. An apparatus for hanging ones or more blinds and one or more curtains comprising:

a first device having a top, a bottom, a first side, a second side, and a rear wall which form an open box, the open box having an opening leading to a chamber;

a second device having a first plate and a first attachment device connected to the first plate of the second device, such that the first attachment device of the second device is substantially perpendicular to the first plate of the second device;

wherein at least a portion of the first attachment device of the second device can be inserted through an opening in the first side of the first device and slid into the chamber of the first device to attach the second device to the first device so that the first plate of the second device is substantially perpendicular to the top, bottom, and rear wall of the first device;

wherein the second device further includes a second attachment device connected to the first plate of the second device, and wherein a first end of a curtain bracket can be attached to the second attachment device of the second device;

a third device having a top, a bottom, a first side, a second side, and a rear wall which form an open box, the open box having an opening leading to a chamber;

a fourth device having a first plate and a first attachment device connected to the first plate of the fourth device, such that the first attachment device of the fourth device is substantially perpendicular to the first plate of the fourth device;

wherein at least a portion of the first attachment device of the fourth device can be inserted through an opening in the first side of the third device and slid into the chamber of the third device to attach the fourth device to the third device, so that the first plate of the fourth device is substantially perpendicular to the top, bottom and rear wall of the third device;

wherein the fourth device further includes a second attachment device connected to the first plate of the fourth device, and wherein a second end of the curtain bracket can be attached to the second attachment device of the fourth device;

wherein the first device can be connected to a first window frame piece so that the first side of the first device lies adjacent to, in contact with, and parallel to an outer surface of the first window frame piece, while at the same time the first plate of the second device lies parallel to the outer surface of the first window frame piece;

wherein the third device can be connected to a second window frame piece, opposite the first window frame piece, so that the first side of the third device lies adjacent to, in contact with, and parallel to an outer surface of the second window frame piece, while at the same time the first plate of the fourth device lies parallel to the outer surface of the second window frame piece.

4. The apparatus of claim 1 wherein the first attachment device of the second device is U-shaped.

5. The apparatus of claim 1 wherein the opening in the first side of the first device is an elongated slot.

6. The apparatus of claim 1 wherein the opening in the first side of the first device can be covered by a panel which can slide over the opening.

7. A method comprising the steps of:

providing a first device having a top, a bottom, a first side, a second side, and a rear wall which form an open box, the open box having an opening leading to a chamber;

providing a second device having a first plate and a first attachment device connected to the first plate of the second device, such that the first attachment device of the second device is substantially perpendicular to the first plate of the second device;

inserting at least a portion of the first attachment device of the second device through an opening in the first side of the first device and sliding the portion into the chamber of the first device to attach the second device to the first device, so that the first plate of the second device is substantially perpendicular to the top, bottom, and rear wall of the first device;

wherein the second device further includes a second attachment device connected to the first plate of the second device, and wherein a first end of a curtain bracket can be attached to the second attachment device of the second device;

providing a third device having a top, a bottom, a first side, a second side, and a rear wall which form an open box, the open box having an opening leading to a chamber;

providing a fourth device having a first plate and a first attachment device connected to the first plate of the fourth device, such that the first attachment device of the fourth device is substantially perpendicular to the first plate of the fourth device;

inserting at least a portion of the first attachment device of the fourth device through an opening in the first side of the third device and sliding the portion into the chamber of the third device to attach the fourth device to the third device, so that the first plate of the fourth device is substantially perpendicular to the top, bottom, and rear wall of the third device;

wherein the fourth device further includes a second attachment device connected to the first plate of the fourth device, and wherein a second end of the curtain bracket can be attached to the second attachment device of the fourth device.

8. The method of claim 7 further comprising connecting the first device to a first window frame piece so that the rear wall of the first device lies adjacent to, in contact with, and parallel to an inner surface of the first window frame piece, while at the same time the first plate of the second device lies adjacent to, in contact with, and parallel to an outer surface of the first window frame piece;

wherein the inner surface of the first window frame piece is substantially perpendicular to the outer surface of the first window frame piece;

and further comprising connecting the third device to a second window frame piece, opposite the first window frame piece, so that the rear wall of the third device lies adjacent to, in contact with and parallel to an inner surface of the second window frame piece; and wherein the inner surface of the second window frame piece is substantially perpendicular to an outer surface of the second window frame piece.

9. The method of claim 7 wherein connecting the first device to a first window frame piece so that the first side of the first device lies adjacent to, in contact with, and parallel to an outer surface of the first window frame piece, while at the same time the first plate of the second device lies parallel to the outer surface of the first window frame piece;

connecting the third device to a second window frame piece, opposite the first window frame piece, so that the first side of the third device lies adjacent to, in contact with, and parallel to an outer surface of the second window frame piece, while at the same time the first plate of the fourth device lies parallel to the outer surface of the second window frame piece.

10. The method of claim 7 wherein the first attachment device of the second device is U-shaped.

11. The method of claim 7 wherein the opening in the first side of the first device is an elongated slot.

12. The method of claim 7 wherein the opening in the first side of the first device can be covered by a panel which can slide over the opening.

13. The apparatus of claim 1 wherein the third device can be connected to the second window frame piece so that the rear wall of the third device lies adjacent to, in contact with, and parallel to the inner surface of the second window frame piece, while at the same time the first plate of the fourth device lies adjacent to, in contact with, and parallel to the outer surface of the second window frame piece.

14. The apparatus of claim 3 wherein when the second device is attached to the first device by the first attachment device of the second device, the first plate of the second device extends outward away from the first device; and when the fourth device is attached to the third device by the first attachment device of the fourth device, the first plate of the fourth device extends outward away from the third device.

15. The apparatus of claim 3 wherein the first attachment device of the second device is U-shaped.

16. The apparatus of claim 3 wherein the opening in the first side of the first device is an elongated slot.

17. The apparatus of claim 3 wherein the opening in the first side of the first device can be covered by a panel which can slide over the opening.

* * * * *